US005338031A

United States Patent [19]

Patla, Sr. et al.

[11] Patent Number: 5,338,031

[45] Date of Patent: Aug. 16, 1994

[54] COMBINATION TILT SWITCH AND PLAYFIELD INCLINE INDICATOR

[75] Inventors: James A. Patla, Sr., Rolling Meadows; James X. Glass, Roselle, both of Ill.

[73] Assignee: Williams Electronics Games, Inc., Chicago, Ill.

[21] Appl. No.: 93,578

[22] Filed: Jul. 19, 1993

[51] Int. Cl.[5] ..... A63F 7/36

[52] U.S. Cl. ..... 273/118 R; 273/118 A; 273/119 R; 273/119 A; 273/121 R; 273/121 A

[58] Field of Search ..... 273/118–125

[56] References Cited

U.S. PATENT DOCUMENTS

| | | | |
|---|---|---|---|
| 2,072,510 | 3/1937 | Moloney | 273/121 A |
| 2,165,059 | 7/1939 | Koci | 273/121 A |
| 2,197,491 | 4/1940 | Bellah | 273/121 A |
| 2,479,707 | 8/1949 | Durant | 273/121 A |
| 4,942,386 | 7/1990 | Willis | 340/566 |

OTHER PUBLICATIONS

Pinball Game advertisement, "The Sporting Goods Dealer", Jan. 1978, p. 298.

*Primary Examiner*—Vincent Millin
*Assistant Examiner*—Raleigh W. Chiu
*Attorney, Agent, or Firm*—Rockey, Rikfin and Ryther

[57] ABSTRACT

The tilt switch/incline indicator of the invention consists of a first support member that is connected to the game cabinet in a known orientation. A second member is pivotably supported on the first member and can be fixed relative thereto at angles corresponding to the desired angle of incline of the playfield. The second member supports a pendulum-type tilt switch similar to that used in the prior art. The pendulum acts like a plumb line to give a visual indication to the game operator that the playfield is at the desired angle set at the second member by observing when the pendulum is centered relative to the contact. The mechanism of the invention uses the tilt switch as the level indicator such that the playfield can be positioned at a known angle without requiring a separate level indicator or the recalibration to the tilt switch.

12 Claims, 2 Drawing Sheets

COMBINATION TILT SWITCH AND PLAYFIELD INCLINE INDICATOR

BACKGROUND OF THE INVENTION

The invention relates, generally, to pinball games and, more particularly, to a combination tilt switch and playfield incline indicator.

The typical pinball game includes an inclined playfield supporting a plurality of play features, a rolling ball and player operated flippers for directing the ball at the play features. Pinball games are typically found in arcades and other similar public places where players pay to play the games. It is known that in an attempt to prolong play, players will lift the game to tilt or redirect the ball to their advantage.

In order to prevent such abuse, game manufacturers have developed tilt prevention mechanisms that terminate play of the game or at least the current ball when the game is tilted. These mechanisms typically include an electrically conductive member suspended from the game cabinet in pendulum fashion and an electrical contact surrounding the conductive member. When the game is tilted, the free end of the member swings into the electrical contact and completes a circuit directing the game's microprocessor to stop play.

A properly installed playfield of a typical pinball game is optimally angled at 6°–7° relative to the horizontal to provide challenging game play and to maximize profits. By adjusting the height of the legs of the pinball cabinet, the game operator can change the angle of the playfield to accommodate slanted floors and the like or to increase or decrease the difficulty of the game. To assist the operator in making these adjustments, some games are provided with a level indicator similar to those found on a typical carpenter's level. For games that do not include such an indicator, the operator must use a separate level or similar device to determine the angle of the playfield. As will be apparent, providing a level indicator on the game increases the cost of the game while omitting such an indicator makes the set up of the game more time consuming and complicated.

Moreover, after the operator adjusts the angle of the game, the tilt prevention switch must be recalibrated to ensure that the pendulum hangs in a proper position relative to the associated electrical contact. Thus, such tilt switches are typically provided with slot and screw arrangements that allow them to be reoriented relative to the game to accommodate changes in the playfield angle. Again, such adjustments are cumbersome and time consuming. Moreover, game operators, in an attempt to simplify the process, have been known to bend the pendulum rather than use the screw and slot arrangement. This can result in the malfunction of the tilt switch.

Thus, an improved tilt switch/incline indicator that will simplify game set up and minimize downtime is desired.

SUMMARY OF THE INVENTION

The tilt switch/incline indicator of the invention consists of a support bracket that is connected to the game cabinet in a known orientation. A second bracket is pivotably supported on the first bracket and can be fixed relative thereto at angles corresponding to the desired angle of incline of the playfield. The second bracket supports a pendulum-type tilt switch similar to that used in the prior art. The pendulum acts like a plumb bob to give a visual indication to the game operator whether or not the playfield is at the desired angle. The game operator can adjust the angle of the playfield until the pendulum is centered relative to the contact at which time the operator will know that the playfield is at the desired angle. Thus, the tilt switch is used as the level indicator such that the playfield can be positioned at a known angle without requiring a separate level indicator or the recalibration of the tilt switch.

DETAILED DESCRIPTION OF THE INVENTION

Figure 1:
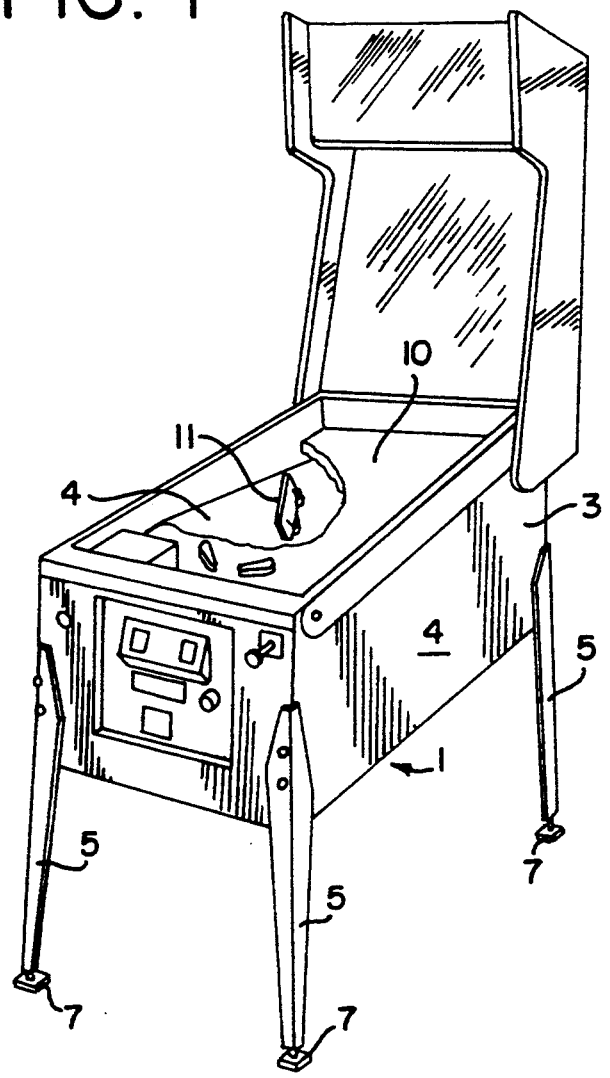
FIG. 1 is a perspective view of a typical pinball game.

Referring to FIG. 1, the typical pinball game 1 includes a game cabinet 3 having legs 5 that have adjustable levelers 7 that can be manipulated to change the angle of the playfield 10 relative to the horizontal. The tilt switch/angle indicator of the invention 11 is fixed to an interior sidewall 4 of the game cabinet 3 by any suitable means such as wood screws.

Figure 4:
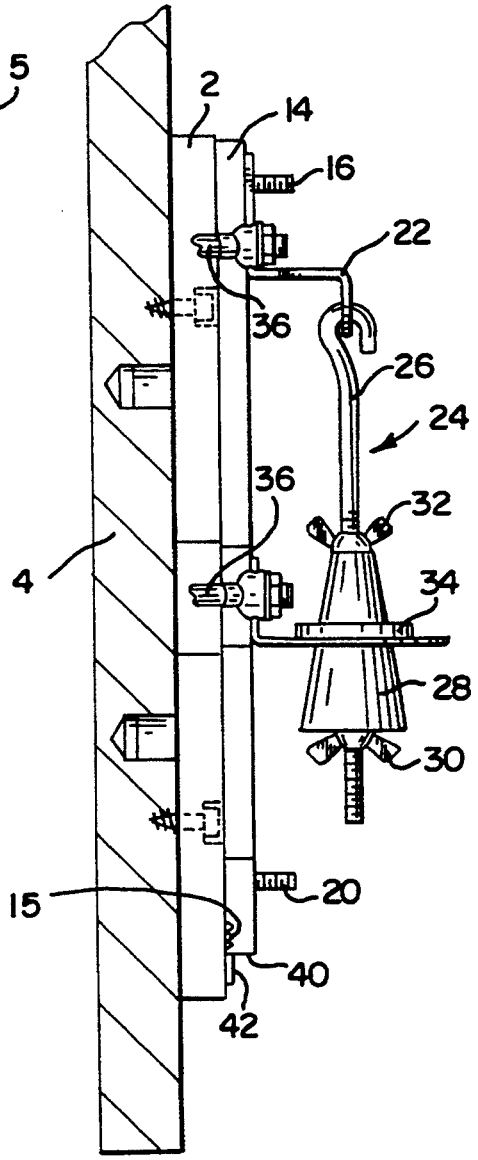
FIG. 4 is a side view of the invention.
Figure 2:
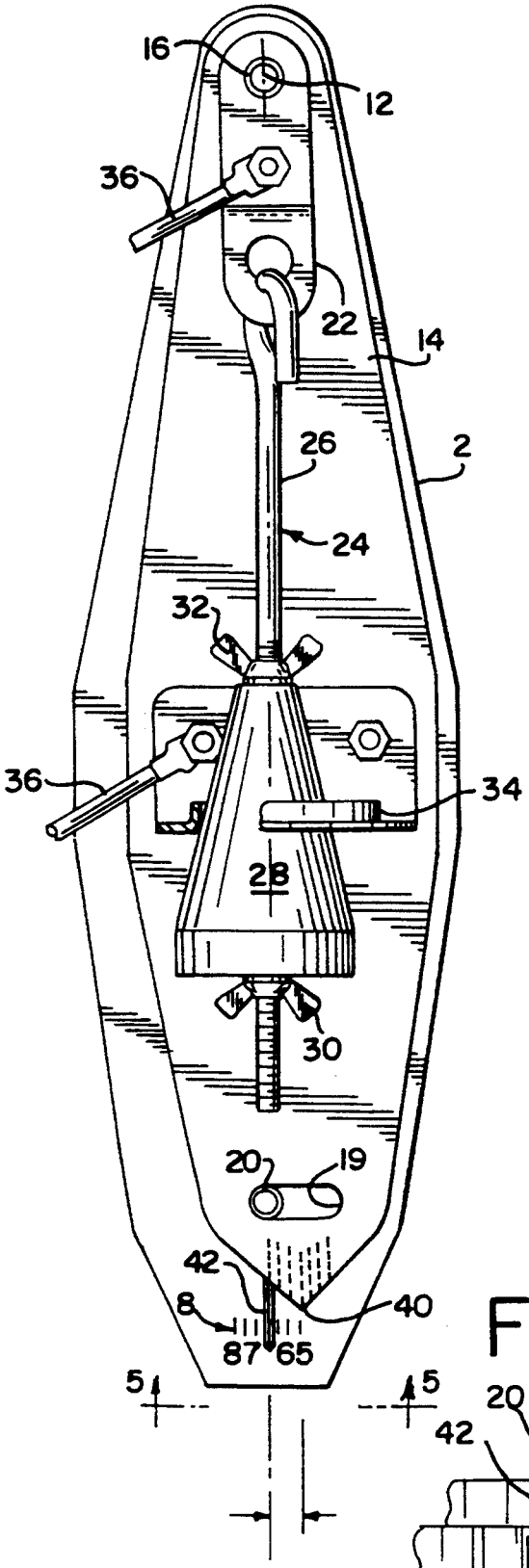
FIG. 2 is a front view of the invention mounted in pinball game cabinet before the angle of incline of the game has been adjusted.
Figure 3:
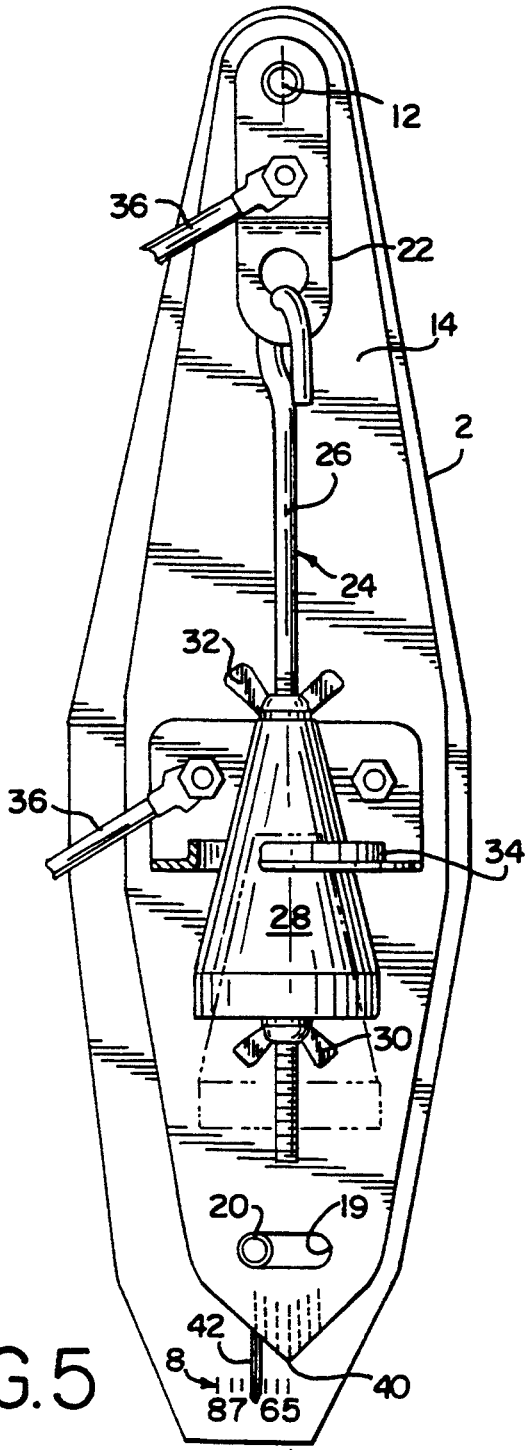
FIG. 3 is a front view of the invention after the angle of incline of the game has been adjusted.
Figure 5:
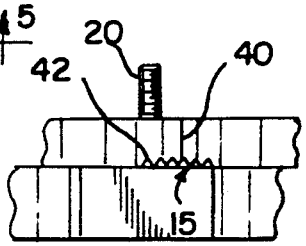
FIG. 5 is a bottom view of the invention.

As best shown in FIGS. 2, 3 and 4, the tilt switch/angle indicator 11 consists of a plate 2 including markings 8 corresponding to the angle of incline of the playfield. The markings cover a range of three degrees in half degree increments corresponding to an angle of incline of the playfield in the range of 5–8 degrees. Other angles could be provided as determined by the nature of the game and/or the desires of the user.

Mounted to support plate 2 at pivot 12 is movable plate 14. Plates 2 and 14 are arranged such that plate 14 rotates about pivot 12 as the playfield inclination is changed. Typically, the plates are mounted on the sidewalls 4 of the game cabinet 3 as shown in FIG. 1. Pivot 12 preferably includes a threaded member 16 supporting plate 14. When member 16 is loosened, plate 14 can pivot and when member 16 is tightened plate 14 is fixed relative to plate 2. A screw 20 and slot 19 are provided to further fix plate 14 relative to plate 2.

The lower end of plate 14 terminates at point 40 and includes a plurality of notches 15 is corresponding to the degree intervals shown on plate 2 as best shown in FIGS. 3 and 4. A selected one of notches 15 is intended to engage protrusion 42 formed on plate 2 to insure that the plate 14 is securely located at the desired angle. Moreover, the cooperation of the notches 15 with the protrusion 42 prevents the plates from slipping relative to one another after the desired angle has been set. Point 40 also gives a visual indication that plate 14 is oriented properly relative to plate 2. In the preferred use of the invention, the plate 14 would be set at 6.5°, however, for illustrative purposes, plate 14 is shown in its most extreme position at the 5° mark.

Plate 14 supports a bracket 22 constructed of electrically conductive material that pivotably supports a pendulum 24 also made of electrically conductive material. Pendulum 24 consists of a threaded member 26 supporting a substantially conically shaped weighted member 28. Member 28 can move relative to member 26 such that its vertical position along member 26 can be changed. Member 28 is held in the desired position by nuts 30 and 32 that engage threaded member 26.

An electrically conductive ring-shaped contact member 34 is fixed to plate 14 and surrounds member 28 such that if the game is tilted, member 28 will contact member 34. Because both bracket 22 and contact 34 are connected to the game's microprocessor by electrically conductive elements or wires 36, when member 28 touches electrical contact 34 a circuit is completed and a signal is delivered to the game's microprocessor informing it that the game has been tilted. The microprocessor can then take appropriate action, such as terminating play of the game, as dictated by the game's program.

By making member 28 conical and moveable along member 26, the amount of tilt required to complete the circuit can be varied thereby allowing variations in the sensitivity of the mechanism. For example, when the conical member is in its lowermost position (as shown in dotted line in FIG. 3) the distance between member 28 and contact 34 is large as compared to when member 28 is in its uppermost position (as shown in solid line). As a result, more tilt is required to complete the circuit when member 28 is in the lowermost position.

The operation of the device will be described with reference to the figures. Plates 2 and 14 are factory mounted relative to the playfield as previously described such that both plates and pendulum 24 are in a vertical orientation. increase or decrease the angle of inclination of playfield 10, plate 14 can be pivoted relative to support plate 2 to increase or decrease the angle of inclination as indicated by markings 8. The members 16 and 20 are tightened to fix the plates relative to one another. The game legs are then adjusted to recenter the member 28 within the contact 34.

Specifically, when plate 14 is pivoted relative to plate 2, member 28 will no longer be centered in contact 34 as shown in FIG. 2. To center member 28, the game cabinet is tilted by the adjustable leg levelers 7 until the member 28 is again centered as shown in FIG. 3. When member 28 is centered relative to contact 34, the playfield will be inclined to the angle indicated on the scale. Thus, member 28 acts like a plumb bob to give a visual indication that the playfield is at the desired angle of incline. The invention allows for accurate inclination of the playfield and the simultaneous centering of the tilt switch.

While the invention has been described in some detail with respect to the drawing, it will be appreciated that numerous changes in the construction and details of the device can be made without departing from the spirit and scope of the invention.

What is claimed is:

1. A pinball game comprising:

a cabinet supporting an inclined playfield; and a combination incline indicator and adjustable tilt switch apparatus including means for detecting undesirable tilting of the playfield during game play and for developing a signal in response thereto, and means for indicating that the game is at a desired angle of incline, said means for indicating being operatively connected to said means for detecting whereby said means for detecting indicates whether the game is at the desired angle of incline.

2. The apparatus according to claim 1, wherein said means for detecting includes a member suspended from the cabinet and a contact spaced from said member whereby when the game is tilted during play the member touches the contact to produce said signal.

3. The apparatus according to claim 2, wherein the member and contact form part of an electrical circuit that is completed when the member touches the contact.

4. The apparatus according to claim 2, wherein the means for indicating includes a plate, means for mounting the plate to the cabinet such that it can be moved and secured in a plurality of positions other than vertical, said plate supporting said member and contact.

5. A pinball game, comprising:

a) a cabinet supporting an inclined playfield;

b) a first member supported for pivoting movement relative to the playfield;

c) means for locking said first member at an angle relative to said playfield, said means for locking includes visual markings indicative of the desired angle, said angle corresponding to the desired angle of incline of the playfield;

d) said first member supporting an electrically conductive pendulum and an electrical contact normally spaced therefrom, said pendulum and contact when touching closing an electrical circuit for signalling that the game has been tilted during play;

e) means for altering the incline of the playfield to position it at a desired angle relative to the horizontal, said pendulum being centered relative to the contact at said desired angle.

6. The apparatus according to claim 5, wherein said first member is mounted for pivoting movement about an axis that is oriented parallel to the axis about which the playfield is tilted.

7. The apparatus according to claim 5, wherein said first member is supported on a sidewall of the cabinet.

8. The apparatus according to claim 5, wherein said means for locking includes a second member secured to said cabinet, said first member being supported on said second member.

9. The apparatus according to claim 8, wherein said first member can pivot relative to said second member.

10. The apparatus according to claim 9, further including means for fixing the first member to the second member.

11. A method for setting the angle of inclination of the playfield of a pinball game and for detecting tilting of the game away from said angle comprising the steps of:

a) mounting a first member for pivotable movement relative to said playfield;

b) locking said first member at an angle relative to said playfield, said angle corresponding to the desired angle of incline of the playfield;

c) mounting an electrically conductive pendulum and an electrical contact on said first member such that when the game is tilted during the game the pendulum will touch the contact to complete a circuit for signalling a tilt condition; and d) altering the inclination of the playfield prior to game play until said pendulum is centered relative to the contact whereby the playfield is at the desired angle of inclination.

12. A pinball game, comprising:

a) a cabinet supporting an inclined playfield;

b) a first member secured to the cabinet at a known angle with respect to vertical;

c) a second member supported for pivoting movement relative to the first member;

d) means for locking the second member at an angle relative to the first member, said angle corresponding to the desired angle of incline of the playfield, and means for indicating said angle;

e) said second member supporting an electrically conductive pendulum and an electrical contact normally spaced therefrom, said pendulum and contact when touching closing an electrical circuit for signalling that the cabinet has been tilted during play;

f) means for altering the incline of the playfield to position it at the desire angle, said pendulum being center relative to the contact at the desired angle.

* * * * *